United States Patent [19]

Brailsford

[11] 4,104,737

[45] Aug. 1, 1978

[54] MIXER APPARATUS

[76] Inventor: Gerold Wayne Brailsford, 490 N. 970 East, Springville, Utah 84663

[21] Appl. No.: 685,737

[22] Filed: May 13, 1976

[51] Int. Cl.[2] ..... B28C 5/00; B01F 7/18

[52] U.S. Cl. ..... 366/65; 366/67; 366/312

[58] Field of Search ..... 259/107, 108, 183, 182, 259/184, 121, 122, 106, 105, 103, 119, 120, 6, 7, 8, 23, 24, 43, 44, 178 A, 145, 185; 51/177; 192/0.02 R; 366/65, 67, 66

[56] References Cited

U.S. PATENT DOCUMENTS

| | | | |
|---|---|---|---|
| 2,065,440 | 12/1936 | Flaum | 259/104 |
| 2,450,299 | 9/1948 | Piper | 259/108 |
| 2,501,016 | 3/1950 | Woodman | 259/107 |
| 2,561,203 | 7/1951 | Joffe | 259/122 |
| 2,571,366 | 10/1951 | Jennings | 259/108 |
| 2,579,874 | 12/1951 | Shaw | 259/107 |
| 2,817,502 | 12/1957 | Yohe | 259/108 |
| 2,932,494 | 4/1960 | Wales | 259/108 |
| 3,421,741 | 1/1969 | Baechler | 259/108 |

*Primary Examiner*—Robert W. Jenkins

*Attorney, Agent, or Firm*—Criddle, Thorpe & Western

[57] ABSTRACT

A portable mixer includes a generally cylindrical housing open at one end thereof, and a mixer blade disposed to rotate within the housing. Located at the other end of the housing is a driven pulley coupled by a belt to a drive pulley mounted on a motor. The driven pulley is coupled through the end of the housing to the mixer blade so that when the driven pulley is rotated, the mixer blade is caused to rotate. The mixer blade includes an elongate, generally flat member which is disposed to rotate in a plane defined by the opening in the housing so that when the housing is placed upon a flat surface, the elongate member rotates just above the surface. The mixer blade also includes a second elongate, generaly flat member spaced from the first mentioned member and disposed to rotate adjacent the inside surface of the wall at the other end of the housing, and a third elongate, generally flat member which extends between the first and second members at one end thereof and is disposed to move adjacent the inside surface of the cylindrical walls of the housing. A switch is mounted in the housing to enable the operation of the motor when the housing is placed with the opening face down on a surface, and to disable the motor when the housing is lifted from the surface.

18 Claims, 7 Drawing Figures

MIXER APPARATUS

BACKGROUND OF THE INVENTION

This invention relates to mixers and more particularly to a portable mixer adapted to mix materials placed upon a support surface.

It is common practice in the masonry trade to mix mortar (and on occasion other cement or concrete produces) by placing the ingredients on a generally flat mortar board and then, using a trowel, mixing the materials until the desired consistency and quality is obtained. This procedure is time consuming, tiring, and, since water is one of the ingredients of mortar, typically messy. Of course, a standard cement or concrete mixer could be used to mix mortar but such mixers are quite expensive and generally unsuited for mixing small quantities of materials which are typically required for masonry work. Also, if a standard mixer is used, the material must be transferred from the mixer onto mortar boards and this can result in loss and waste of the mortar in splashing from the boards.

SUMMARY OF THE INVENTION

It is an object of the present invention to provide a lightweight, compact portable mixer.

It is also an object of the present invention to provide such a mixer which is especially adapted for mixing and blending ingredients placed upon a support surface.

These and other objects of the invention are realized in an illustrative portable mixer which includes a housing having side walls and a top wall and open at the bottom thereof, a mixer blade or paddle disposed to move within the housing to mix and agitate material over which the housing is placed, and apparatus for causing the mixer blade to move within the housing. In accordance with one aspect of the invention, the margin of the opening in the housing is formed to define a plane and the mixer blade is adapted to move generally adjacent to that plane to contact and move materials on a support surface on which the housing is placed.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
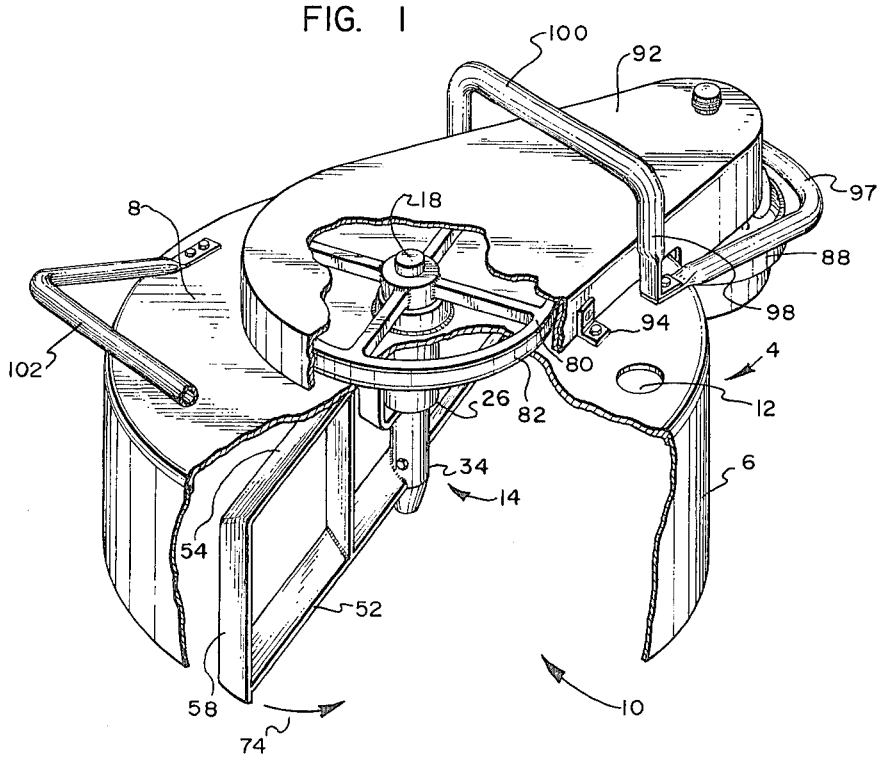
FIG. 1 shows a perspective, partially cut away view of a portable mixer made in accordance with the present invention.
Figure 2:
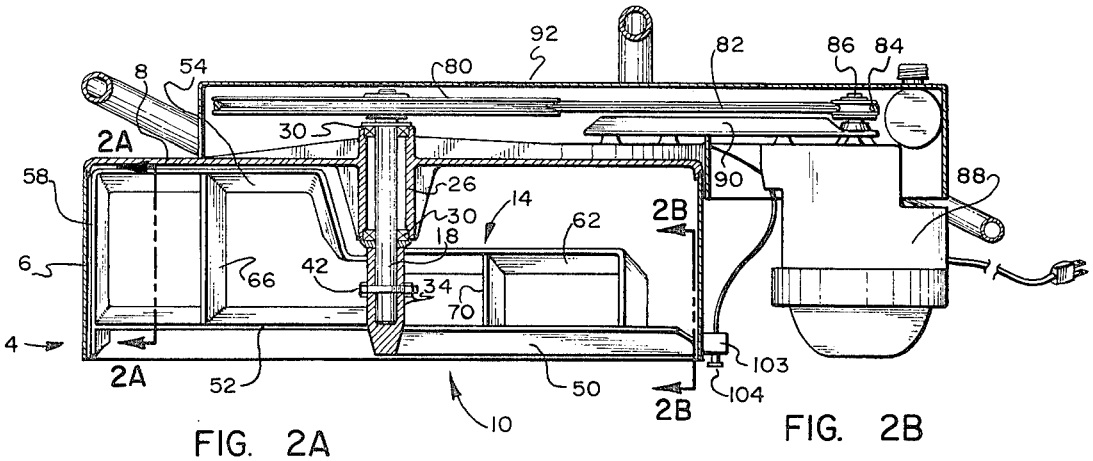
FIG. 2 is a side, elevational, cross-sectional view of the mixer of FIG. 1.
Figure 3:
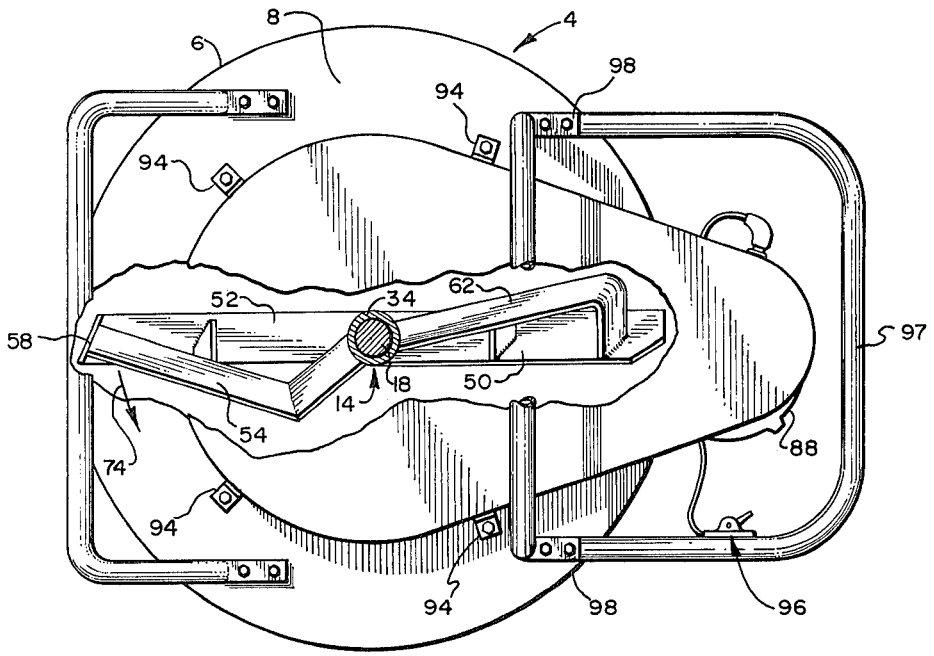
FIG. 3 is a top, plan, partially cut away view of the mixer of FIG. 1.

Referring to the drawings and especially to FIGS. 1, 2 and 3, there is shown one illustrative embodiment of a portable mixer made in accordance with the principles of the present invention. The mixer includes a generally cylindrical housing 4 having a cylindrical side wall 6, a top wall 8 at one end thereof, and an opening (indicated by arrow 10) at the other end thereof. The top wall 8 and side wall 6 may be constructed integrally or by joining two separate pieces together as generally indicated in FIG. 1. The bottom margin of the cylindrical side wall 6 forming the opening defines a generally flat plane. An opening 12 is located in the top wall 8 to allow passage of air.

Rotatably mounted in the top wall 8 of the housing is a shaft 18 which extends through the top wall into the interior thereof and on which is mounted a mixer blade 14. Formed in the top wall 8 of the housing 4 is a cylinder 26 for rotatably mounting the shaft 18 (see FIG. 2). Bearings 30 are positioned within the cylinder 26 about the shaft 18 at either end of the cylinder. One end of the shaft 18 extends out the top wall 8 of the housing 4 while the other end of the shaft extends downwardly within the housing.

The mixer blade 14 includes a central sleeve 34 which is dimensioned to fit over the end of the shaft 18 as best seen in FIG. 2. The sleeve 34 is placed on the end of the shaft 18 until a lip 38 of the sleeve abuts against the lower end of the cylinder 26 formed in the top wall 8 of the housing. A bolt 42 (or other suitable fastener) holds the sleeve 34 on the shaft 18 by insertion through aligned bores in the sleeve and shaft. Because of bolt 42, when the shaft 18 is rotated, the sleeve 34 will be caused to rotate.

Extending radially outwardly from the lower end of the sleeve 34 is an elongate, generally flat bottom element 50. The element 50 extends within the housing 4 from near one side thereof to near the other side and is disposed to rotate adjacent to the plane defined by the opening 10 in the housing. This is best seen in FIG. 2 which shows the element 50 disposed just above the plane defined by the opening 10. Also extending radially outwardly from the sleeve 34 in the opposite direction of element 50 is a second elongate, generally flat bottom element 52. Element 52, however, is located at a higher elevation than is element 50.

The mixer blade 14 further includes an elongate, generally flat upper element 54 which is spaced above the bottom element 52 and is attached to and extends outwardly of the sleeve 34. The element 54 is attached to the upper end of the sleeve 34 and extends outwardly a short distance and then upwardly toward the top wall 8 and then again outwardly to near the interior surface of the side wall 6 (see FIG. 2). The upper element 54 is disposed to move adjacent to the interior surface of the top wall 8. Joining the end of element 54 and one end of the element 52 is a side element 58 formed of a piece of elongate, generally flat material. The side element 58 is disposed to move, when the mixer assembly 14 is rotated, adjacent the interior surface of the cylindrical wall 6.

Figure 2A:
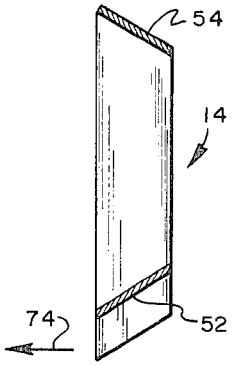
FIGS. 2A and 2B are respectively a cross-sectional view of the mixer blade of FIG. 2 taken along lines 2A—2A and an end view of the mixer blade of FIG. 2 taken along lines 2B—2B.
Figure 2B:
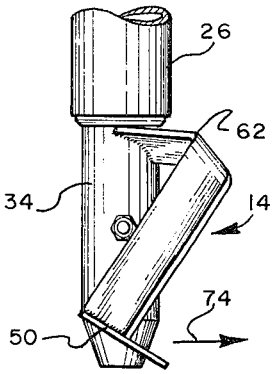

The mixer blade 14 additionally includes a fifth elongate, generally flat blade element 62 which extends outwardly from near the upper end of the sleeve 34. The outer end of the blade element 62 is bent to extend downwardly to attach to the bottom element 50 as seen in FIGS. 2 and 2B. The blade element 62 is spaced above the bottom blade element 50 about one-half the distance of the spacing between the upper blade element 54 and the bottom blade element 52. Vertical cross members 66 and 70 extend respectively between the upper element 54 and bottom element 52 and between the blade element 62 and bottom element 50.

The mixer blade 14 is designed to rotate and thereby mix, agitate and blend materials placed on a generally flat support surface over which the housing is positioned. This mixing capability is facilitated by the orientation of the various blade elements as seen in the different FIGS. That is, bottom blade elements 50 and 52 are inclined at an angle upwardly from the plane defined by the opening 10 and away from the direction of rotation of the mixer blade 14, which direction is indicated by the arrow 74 in the FIGS. With this orientation of the bottom elements, a type of propeller action is produced when the elements are rotated with the result that material contacted by the elements is forced upwardly and thereby fluffed and bellowed. This propeller action effect can be visualized by referring to FIGS. 2A and 2B which show the angular orientation respectively of the elements 50 and 52 with respect to the direction of movement of the elements. As noted earlier, one side edge of the element 50 moves just above the plane defined by the opening 10 in the housing.

The other elements of the mixer blade 14 are similarly inclined or oriented at particular angles. Thus, the trailing edge of side element 58 is inclined inwardly from the side wall 6 as best seen in FIG. 3. The trailing edge of the upper element 54 is inclined downwardly from the interior surface of the top wall 8 as best seen in FIG. 2A. The positioning of side element 58 enables the side element to contact and force from the interior surface of the cylindrical wall 6 any material clinging to the wall. Similarly, the positioning of upper element 54 enables the element to contact and force from the interior surface of the upper wall any material clinging to that surface.

The trailing edge of blade element 62 is inclined upwardly as best seen in FIG. 2B. The vertical cross member 66 and 70 are positioned at angles as shown in FIG. 3 to serve to force material inwardly when the mixer blade is rotated.

The upper element 54 and the element 62 are offset from the bottom elements 52 and 50 respectively as best seen in FIG. 3. In particular, the upper element 54 extends initially outwardly of the sleeve 34 in a direction different from the direction of the bottom element 52 and then bends to extend toward the side element 58 which, in turn, extends vertically upwardly from the bottom element 52. Thus, in the direction of rotation of the mixer blade 14, the upper element 54 leads the bottom element 52 as indicated in FIG. 3. The blade element 62 similarly is disposed to lead the bottom element 50 in the direction of rotation of the mixer blade 14.

It is apparent from an examination of FIG. 2 that each blade element traverses a different path during rotation of the mixer blade. For example, bottom element 50 moves just above the plane defined by the opening 10 in the housing, bottom element 52 moves generally in a plane above element 50, element 62 moves generally in a plane above bottom element 52, etc. With this configuration of blade elements, material being mixed by the apparatus is efficiently blended, agitated and mixed.

Mounted on that end of the shaft 18 extending out of the top wall 8 of the housing is a driven pulley 80. The pulley 80 is rigidly mounted to the shaft 18 so that when the pulley 80 is rotated, the shaft 18 is caused to rotate. A belt 82 is positioned about the pulley 80 and drivingly couples the pulley 80 to a drive pulley 84 mounted on the drive shaft 86 of a motor 88 mounted at the side of the housing 4. Obviously, when the drive pulley 84 is caused to rotate by the motor 88, the driven pulley 80 is rotated to thereby cause the mixer blade 14 to rotate. The motor 88 may be mounted at the side of the housing by any suitable bracket arrangement such as bracket 90 shown in FIG. 2 as extending upwardly from the top wall 8 of the housing and then laterally outwardly to support the motor 88 depending from the bracket. Advantageously, the bracket 90 may be made to be adjustable so that the motor 88 may be moved toward or away from the pulley 80 to thereby adjust the tension in the belt 82. The motor 88 is shown in the drawings to be a conventional electric motor but it should be understood that a suitable gasoline or other type engine could also be used. A belt and pulley housing 92 is positioned over the pulley 80, belt 82 and pulley 84 and held in place by suitable brackets 94.

Advantageously, the motor 88 includes a variable speed control switch 96 (or throttle in the case of a gasoline engine) which, when placed in an "idle" position, allows the drive pulley 84 to remain at rest, and when moved to an "operate" position causes the motor to operate at a speed dependent upon the setting of the switch. With such an arrangement, no external clutch mechanism is necessary. Rather, simple operation of the switch 96 controls the rotation of the mixer blade 14. Such variable speed control switches are well known in the art. (If a gasoline engine were used, a centrifugal clutch arrangement could be employed to allow "idling" the drive pulley 84 in a rest position.)

The variable speed control switch 96 is, for convenience, mounted on a U-shaped handle 97 which extends about the motor 88 and is mounted on the top wall 8 of the housing 4. The handle 97 serves both to facilitate handling of the mixer and to guard and protect the motor 88. Another handle 100 extends from the top wall 8 up and over the belt and pulley housing 92 to facilitate hand carrying and operation of the mixer. The handle 100 is positioned so that the weight on either side thereof is substantially the same and this, of course, allows for balanced portability and carrying of the mixer. To facilitate carriage of the mixer by two persons, a third generally U-shaped handle 102 is mounted on the top wall 8 of the housing 4 near the side of the housing opposite the side on which the motor 88 is mounted. With this arrangement, one person could grasp the handle 97 and another person could grasp the handle 102 for carrying the mixer therebetween. Of course, a variety of other arrangements suitable for carrying the mixer could be devised. A portion of the handle 102 is generally straight and is aligned with the side wall 6 of the housing 4 to stabalize the apparatus when it is postioned on its end. That is, the handle 102 acts as a leg to support the apparatus.

For safety purposes it is desirable that when the mixer is not in place on a support surface, the mixer blade 14 be disabled from rotating. To accomplish this, a switch 103 is mounted on the exterior surface of the cylindrical wall 6 adjacent the lower margin of the wall as shown in FIG. 2. Extending downwadly from the switch housing is a plunger 104 which is spring actuated to extend below the bottom margin of the cylindrical wall 6 when no force is applied to the plunger. In this position, the switch is "open" so that no electricity can be applied to the motor 88. When the mixer is placed upon a support surface, the plunger 104 is forced into the switch housing 103 to "close" the switch and allow electricity to be applied to the motor. Such switches with plungers are well known in the art. Of course, the electrical power would be routed from the electrical source first through the switch 103, then to the variable speed control switch 96 and finally to the motor 88. With this feature, the only time the mixer blade 14 can be rotated is when the plunger 104 is pushed into the switch housing 103 and this would normally occur when the mixer were placed upon a support surface, but not otherwise.

Figure 4:
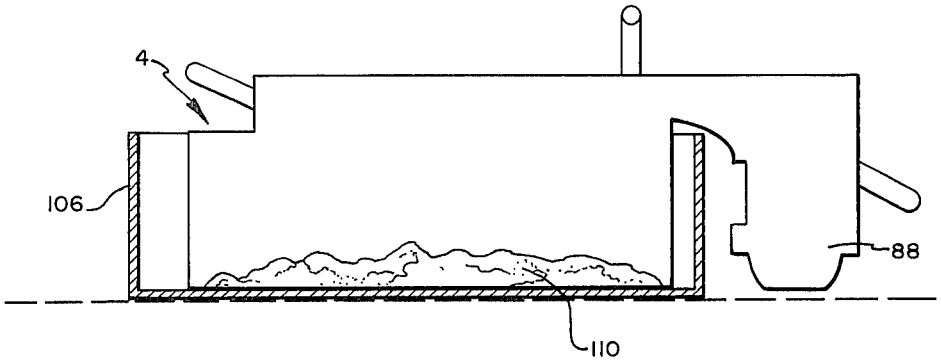
FIG. 4 is a diagramatic, side elevational view of the mixer of FIG. 1 shown positioned in a tub.
Figure 5:
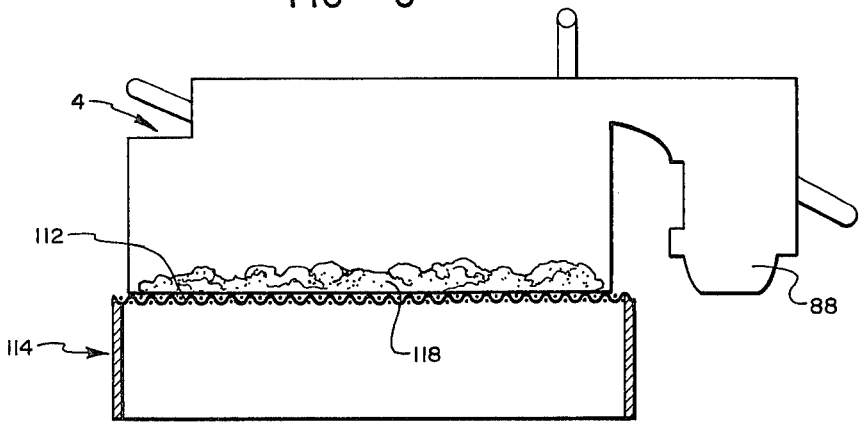
FIG. 5 is a diagramatic, side, elevational view showing the mixer positioned in a sifting screen structure.

FIGS. 4 and 5 show different uses of the mixer of the present invention. In FIG. 4, the mixer is diagramatically shown positioned in a tub 106 into which cement, water and the like 110 has been placed for mixing. The housing 4 of the mixer would be positioned so that the side walls 6 thereof encircled the material 110 and then the mixer blade 14 would be rotated to mix and blend the material to the desired consistency and quality. By mounting the motor 88 at one side of the housing with a bracket which extends from the top of the housing 4 to the motor and from which the motor depends, the housing alone may be placed in the tub 106 as shown in FIG. 4. This may be advantageous since the liklihood of slopping mortar or other material being mixed onto the motor is reduced because the motor is positioned outside the tub.

FIG. 5 shows the mixer positioned on a screen 112 of a sifting screen structure 114 so that the housing 4 is positioned over gravel or similar material 118 which is to be screened and sifted. The side walls of the housing 4 again encircle the material 118 so that by rotating the mixer blade 14, the material 118 will be agitated and the smaller particles thereof will fall through the screen 112 as desired.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements. Although the mixing apparatus has been described especially for mixing mortar, it should be apparent that the apparatus could be used for mixing a variety of materials including feed for animals, concrete grout, cement finishing mix, plaster, etc.

What is claimed is:

1. A portable mixer for mixing mortar and the like comprising a housing having side walls and a top wall and open at the bottom thereof, with the margin of the opening substantially defining a plane so that the housing may rest stably on a generally flat surface, a mixer blade disposed to move within the housing generally in the plane defined by the opening in the housing to thereby mix and agitate material positioned on a support surface on which the housing is placed, motor or engine means mounted on the housing, means responsive to the operation of the motor or engine means for driving said mixer blade to move within the housing, and variable speed control means for causing the motor or engine means to operate at variable speeds to thereby cause said driving means to move the blade at variable speeds.

2. A portable mixer as in claim 1 wherein said mixer blade includes an elongated bottom element disposed to move generally in the plane defined by the margin of the opening.

3. A portable mixer as in claim 2 wherein said housing is generally cylindrical in shape, and wherein the elongated bottom element of said mixer blade is disposed generally horizontally in the housing to rotate about a generally vertical axis.

4. A portable mixer as in claim 2 wherein the bottom margins of the side walls of the housing define and circumscribe the opening at the bottom of the housing, and wherein said mixer blade includes a side element disposed to move adjacent the inside surface of the side walls of the housing to remove material clinging thereto, and an upper element disposed to move adjacent the inside surface of the top wall of the housing to remove material clinging thereto.

5. A portable mixer as in claim 4 wherein said mixer blade further includes a first bottom element disposed to move adjacent the opening at the bottom of the housing, and a second bottom element disposed to move generally in a plane above the first bottom element.

6. A portable mixer as in claim 5 wherein said first bottom element includes a first elongate, generally flat member, one side edge of which is disposed to move adjacent the plane defined by the housing opening to thereby contact and move material resting on the support surface on which the housing is placed, wherein said upper element comprises a second elongate, generally flat member, one side edge of which is disposed to move adjacent the inside surface of the top wall of the housing to thereby contact and force from the top wall surface material clinging thereto, and wherein said side element comprises a third elongate, generally flat member, one side edge of which is disposed to move adjacent the inside surface of the side walls of the housing to thereby contact and force from such surface material clinging thereto.

7. A portable mixer as in claim 6 wherein said first member is oriented at an angle to the plane defined by the opening such that material resting on the support surface on which the housing is placed and which is contacted by the first member is forced upwardly from the surface, wherein said second member is oriented at an angle to the inside surface of the top wall of the housing such that material contacted by the second member is forced downwardly from the top wall, and wherein said third member is oriented at an angle to the inside surface of the side walls of the housing such that material contacted by the third member is forced inwardly toward the center of the housing.

8. A portable mixer as in claim 1 wherein said housing is generally cylindrical in shape with the opening being located at one end thereof, and wherein said mixer blade is adapted to rotate within the housing about a mixer axis which is generally parallel with the cylindrical axis of the housing.

9. A portable mixer as in claim 8 wherein said mixer blade includes a first elongate member disposed to extend from near the mixer axis to near one side of the opening generally adjacent the plane defined by the opening, and adapted to rotate about the mixer axis which is substantially perpendicular to the first member, a second elongate member disposed to extend from near one side of the housing to the mixer axis generally adjacent the inside surface of the top wall of the housing, said second member being adapted to rotate about the mixer axis, and a third elongate member disposed to extend downwardly from the outer end of the second member generally adjacent the inside surface of the side walls of the housing.

10. A portable mixer as in claim 9 wherein said mixer blade further includes a fourth elongate member spaced generally above the first member and extending from near one side of the housing to the mixer axis and being adapted to rotate about the mixer axis, and a fifth elongate member spaced generally below the second member and extending from near one side of the housing to the mixer axis and being adapted to rotate about the mixer axis.

11. A portable mixer as in claim 10 wherein said mixer blade further includes a cross member extending between the first and fourth elongate members, and a cross member extending between the second and fifth elongate members.

12. A portable mixer as in claim 1 wherein said driving means includes a shaft rotatably mounted in the top wall of the housing so that one end of the shaft extends within the housing and the other end thereof extends out of the top wall, said mixer blade being mounted on said one end of the shaft, a driven pulley mounted on said other end of the shaft so that rotation of the driven pulley causes the shaft and thus the mixer blade to rotate, and wherein said motor or engine means is coupled to the driven pulley for causing the pulley to rotate.

13. A portable mixer as in claim 12 wherein said driving means further includes a drive pulley coupled to said driven pulley, and wherein said motor or engine means is mounted laterally of a side wall of the housing, said mixer further including a mounting bracket which extends outwardly from the top of the housing and on which the motor or engine means is mounted.

14. A portable mixer as in claim 1 further comprising switch means adapted to disable said motor or engine means from operating when the housing is not resting on a support surface.

15. Apparatus for mixing materials placed on a surface comprising a generally cylindrical housing open at a bottom end thereof, with the margin of the opening generally defining a plane, a mixer structure disposed to rotate within the housing, said mixer structure including a first elongate, generally flat blade extending within the housing from the axis of rotation of the blade radially to near the side of the housing, and a second elongate blade extending upwardly from the end of the first blade and disposed to move adjacent the interior surface on the sides of the housing, one edge of said first blade being adapted to move in the plane defined by the opening in the housing and the opposite edge being inclined away from the plane defined by the housing opening, and means mounted at a top end of the housing and coupled to the mixer structure for causing the structure to rotate.

16. Apparatus as in claim 15 wherein the mixer structure further includes a third elongate blade disposed to rotate adjacent the interior surface of the top end of the housing.

17. Apparatus as in claim 16 wherein the third elongate blade is generally flat, having a leading edge and a trailing edge, and extends from the axis of rotation of the blade to near the side of the housing, wherein the trailing edge of the third elongate blade is inclined away from the interior surface of the top end of the housing, and wherein the second elongate blade is generally flat, having a leading edge and a trailing edge, said trailing edge of the second elongate blade being inclined away from the interior surface of the sides of the housing.

18. Apparatus as in claim 15 further comprising switch means operable to enable operation of said causing means when the housing is placed on a surface with the housing opening facing downwardly, and to disable the operation of said causing means when the housing is lifted from such surface.

* * * * *